United States Patent [19]

Adcock

[11] 4,387,776

[45] Jun. 14, 1983

[54] WELL CASE DRIVING ANVIL

[76] Inventor: Gerald L. Adcock, 2033 3rd Ave. North, Lewiston, Id. 83501

[21] Appl. No.: 209,652

[22] Filed: Nov. 24, 1980

[51] Int. Cl.[3] ..... E21B 4/06; E21B 7/20

[52] U.S. Cl. ..... 175/293; 166/178

[58] Field of Search ..... 175/293, 294, 171, 306, 175/300, 402; 173/128, 132; 166/178, 301, 98, 99, 55, 55.1; 405/245; 174/7

[56] References Cited

U.S. PATENT DOCUMENTS

| | | | |
|---|---|---|---|
| 1,858,500 | 5/1932 | Hinderliter | 166/301 |
| 1,908,217 | 5/1933 | Blumenthal | 175/293 X |
| 3,190,378 | 6/1965 | Davey, Sr. et al. | 175/257 |
| 3,690,380 | 9/1972 | Grable | 166/55.1 X |
| 3,835,943 | 9/1974 | Bray | 175/135 |

*Primary Examiner*—Stephen J. Novosad
*Attorney, Agent, or Firm*—Wells, St. John & Roberts

[57] ABSTRACT

A downhole casing anvil device is described that provides a surface against which the casing can be driven down a drilled hole from near the bottom of the casing. The anvil device includes a solid body having a mounting plate that is complementary to the cross-sectional configuration of the casing, and an anvil shoulder that projects outwardly therefrom. The shoulder is adapted to fit through an aperture in the casing and to project into the casing interior. The plate includes a mounting surface that fits flush against the casing when the anvil shoulder is fitted through the casing aperture. Axial edges of the plate may be welded to the casing, clear of the aperture, to secure the anvil device to the casing.

12 Claims, 4 Drawing Figures

WELL CASE DRIVING ANVIL

TECHNICAL FIELD

The present invention relates to well casing driving anvils that attach to a well casing, providing a striking surface against which a hammer drives the casing down a drilled hole. More particularly, the invention relates to such an anvil that is adapted to be mounted to a well casing at or adjacent the casing bottom end, thereby facilitating "downhole" casing driving.

BACKGROUND OF THE INVENTION

Conventional exploratory and well drilling operations use the same basic approach for sinking well casing down the drilled hole. Sections of casing are fitted together at ground level and driven from the top of the hole downwardly as drilling progresses. In essence, the drill string is progressively pushed down the drill hole.

Frictional resistance to downward movement increases as the hole depth increases, therefore correspondingly increasing the requirements for case driving forces. Long drill strings have a tendency to buckle as a long column under compression. The surrounding earth prevents such buckling at the cost of increased friction against the sides of the drilled hole. More driving force is therefore required as the length of casing increases. A casing driven from the top of the hole will normally follow the drilled hole but not with the desired degree of accuracy, especially in soft ground. Section welds can easily become damaged due to constant lateral shifting (partial buckling) under the high compressive forces incurred.

The above problems were recognized to a limited degree by Davey, Sr. et al in U.S. Pat. No. 3,190,378 granted June 22, 1965. The Davey casing driving mechanism makes use of apparatus for both drilling and for pulling casing downwardly into a drilled hole. A rotary drill bit is releasably connected to a casing shoe mounted to the bottom of the casing. As the rotary drill bit rotates, inverted L shaped brackets on the rotary bit engage dogs that project inwardly from the casing shoe. The casing shoe is mounted to the bottom of the casing and rotates with the rotary drill bit. The bit rotates the casing shoe and pulls the casing downwardly as the drilling progresses. At the end of the drilling operation, the drill tool is rotated in an opposite direction to disengage the rotary bit and the inverted L shaped brackets from the dogs, thus enabling retraction of the rotary bit and the drill string up through the casing.

The Davey cutting and casing driving shoe is extremely expensive. The shoe must have especially hardened and formed drill teeth at lower ends and an appropriate sealed bearing at upward ends where the shoe is connected to the casing bottom. The bearing must be constructed both to withstand downward forces imparted by the drill tool and to allow relatively free rotation of the shoe so that torsional forces are not transmitted from the rotating drill bit to the casing. Additionally, should the bearing fail or freeze, the shoe will transmit torsional forces directly to the casing as the drill bit rotates. Such a failure could result in damage to the casing and would require the entire string to be removed from the drilled hole for repair.

A pile driving device is shown in the U.S. Patent to Blumenthal, U.S. Pat. No. 1,908,217 granted May 9, 1933. Blumenthal discloses a drive point that is hammered into the ground by a downhole pile driver. The pile shell is pulled downwardly by the downhole pile driver. The Blumenthal device is used exclusively for driving pilings and does not suggest use in a drilling operation in which earth material must be removed from the hole. Blumenthal, however, exemplifies the desirability for downhole "driving" of a piling shell to prevent compressive damage of the piling shell and to decrease the force required to move the piling shell down the hole.

Blumenthal makes use of a transverse bar that is affixed to inward surfaces of the casing as an anvil surface. The pile driving device strikes a top surface of the rod to transmit downward driving forces to the attached piling. The area of contact between the bar and piling is limited to the cross-sectional area of the bar where it is attached to the piling. Thus, tremendous impact forces are to be absorbed across a relatively small cross-sectional area of the rod. Furthermore, the bar extends completely across the piling interior, blocking passage of the impact device to areas below the rod.

The above described apparatus disclosed by Blumenthal and Davey clearly illustrate the desirability to provide some form of downhole driving for casing or pilings. However, both are plagued with limitations, especially in the area of the driving "anvil" surface that is provided on the casing to transmit forces from the driving member to the casing. Davey, for example, uses inwardly projecting dogs on the rotatable drill shoe. Since the dogs rotate relatively freely within the casing, there is no fixed position about the casing axis specifically provided for imparting downward driving force to the casing. The rotating dogs, instead, transmit downward driving force continuously during rotation. The result is combined downward force and a resultant torsional force due to rotation, even though the rotational forces are minimized (hopefully) by the bearing mounts.

Davey's apparatus is used strictly for rotary drills. It would not operate effectively, if at all, in conjunction with present percussion drilling equipment. The drilling mechanisms is percussion drilling move in vertical, up and down hammering strokes. Therefore, driving dogs such as those disclosed by Davey, mounted on a rotating shoe, could not be trusted to remain in the same angular position about the axis of the casing for proper alignment with hammering surfaces on the impact drill tool. Furthermore, the bearings mounting the shoe to the casing bottom would more than likely fail under the continuous impact driving forces. Blumenthal, on the other hand, provides a stationary driving surface. However, such surface is mounted in such a way that would not permit its use by impact drilling tools, since the driving surface extends entirely across the casing. Furthermore, the points of attachment of the driving surfaces could easily fail if adapted to fit within a standard well casing due to the small cross-sectional areas of engagement between the striking surfaces and casing walls.

The present case driving anvils mount through apertures formed in conventional well casings upward from the casing bottom and are fixed in relation to the casing. The anvil surface remains in position in alignment with the impact driving hammer. The anvil and casing are relatively stationary so there are not moving parts to malfunction or break. Furthermore, the present anvil structure is provided to reinforce the casing area lost through the mounting apertures, providing a large area of contact with the casing and attachment to the casing at points spaced from the driving surface and aperture so forces are more evenly distributed to the casing during impact.

BRIEF DESCRIPTION OF THE DRAWINGS

A preferred embodiment of the present invention is illustrated in the accompanying drawings in which.

DETAILED DESCRIPTION OF A PREFERRED EMBODIMENT

The present anvil device designated at 10 in the accompanying drawings is provided to be secured to a well casing 11 upwardly adjacent the casing bottom end. The present device provides a surface against which the casing can be driven down a previously drilled hole. It is intended that the present anvil device 10 be used in conjunction with impact driving equipment in order to transmit axial driving forces to the casing.

Figure 2:
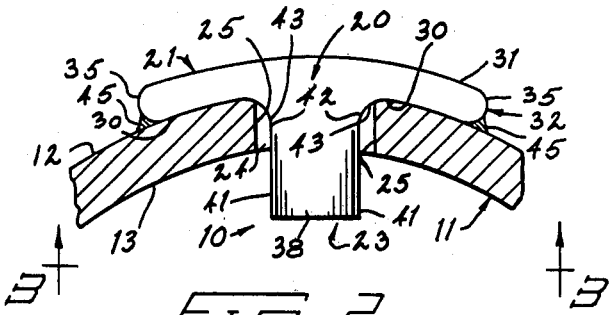
FIG. 2 is a top plan view showing the present anvil device mounted to a casing, the casing being fragmented and shown in cross section.
Figure 4:
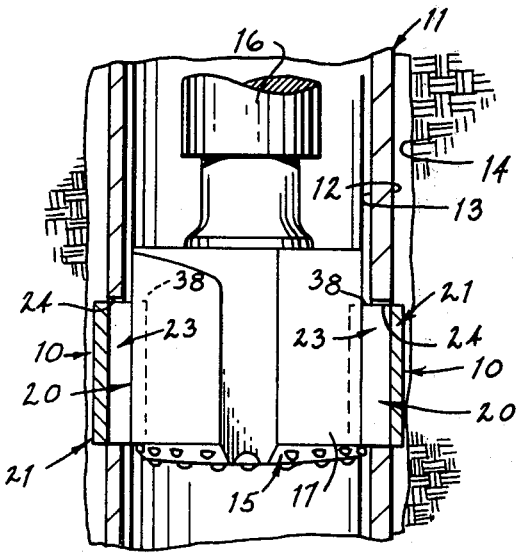
FIG. 4 is a reduced operational view showing two of the present anvil devices mounted to a casing and engaged by a combined drill bit and impact tool.
Figure 3:
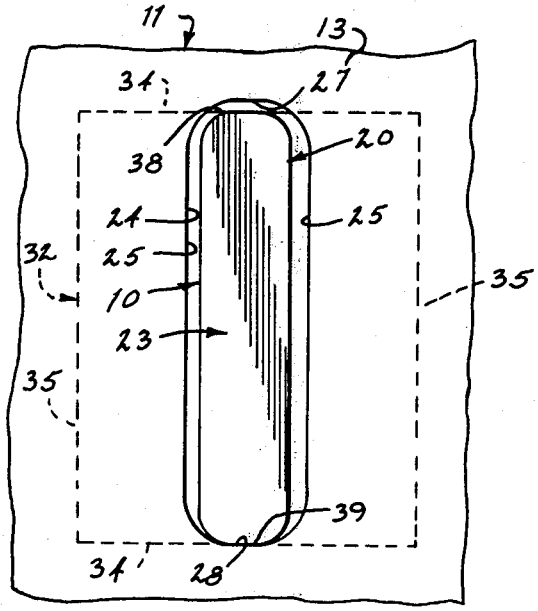
FIG. 3 is a view of the anvil device and casing fragment as seen from line 3—3 in FIG. 2.

A typical casing 11 is shown partially in FIGS. 2 through 4. The casing 11 includes a tubular cross section, preferably cylindrical. It includes a cylindrical outer exterior wall 12 and a coaxial cylindrical interior wall 13. The cross-sectional size of the casing is designed to fit somewhat loosely within a previously bored hole 14 (FIG. 4) and thus varies with the bore diameter.

The casing 11 is used to line the bored hole 14 to prevent the hole from being filled with loose material and from being contaminated by seepage along the hole length. The casing is placed in elongated sections at the surface drilling rig. The individual casing sections are typically welded end-to-end as the hole is formed and the casing is moved into the hole.

The casing 11 is periodically driven downwardly into the previously drilled hole 14 by a percussion impact drilling device generally shown in FIG. 4 at 15. The impact device 15 may include a hammer actuator 16 that is positioned down the drilled hole at the end of an elongated drill string (not shown). The hammer actuator may mount a bit 17 that functions both to drill the hole and drive the casing. The bit 17 performs two functions. Firstly, a boring surface at the bottom end of the bit may be impacted against the earth to bore the hole. The bit 17 can then be pulled upwardly within the casing, past the present anvil device 10, turned and lowered into engagement with the anvil device. Hammering action can then be initiated with impact of the bit 17 received by the present anvil device and transmitted directly to the casing, driving the casing down the hole to the newly formed bottom. The unit 17 can then be lifted from engagement with the anvil device 10, turned and lowered downward beyond the device to clear the contained drilled material from the casing and to initiate a subsequent drilling operation.

Mounting apertures 24 required for the present anvil device are drilled or cut from the casing prior to the drilling operation. Preferably, two such apertures 24 are formed in the casing at diametrically opposed locations thereon. The two apertures 24 receive two identical anvil devices 10 that cooperate with an impact device 15 designed to operate against two anvils.

Preferably, the apertures 24 (FIG. 3) are elongated and axial in relation to the casing axis. For purposes of later description, each aperture 24 includes longitudinal or axial side edges 25 that are substantially parallel with the longitudinal upright axis of the casing. The side edges 25 are joined by top and bottom aperture ends 27 and 28 respectively. The distance between side edges 25 represents the width dimension of the aperture and the distance longitudinally between the top end 27 and bottom end 28 represents an axial height dimension.

The present anvil device 10 is preferably formed with an integral, cast or forged rigid anvil body 20. The body 20 is comprised of two integral parts, a mounting plate 21 and an anvil shoulder 23 projecting outwardly therefrom. The plate member 21 is adapted to secure the body 20 to the casing exterior wall 12. The anvil shoulder 23 is adapted to extend through the aperture 24 formed in the casing into the casing interior, presenting a striking or impact surface to the impact device 15.

A flush engagement between the mounting plate 21 and exterior surface 12 of the casing is assured by an inwardly facing curved surface 30 of the plate 21. The surface 30 is complementary to the cross-sectional configuration of the casing as shown in FIG. 2. The curved inside surface 30 is spaced inwardly from a similarly formed outside surface 31. The surfaces 30 and 31 are bounded by peripheral edges 32 extending about the surfaces 30 and 31. The peripheral edges of the plate are adapted to be welded to the casing along the exterior wall. Specifically, longitudinal sections 35 of the peripheral edges 32 are provided with rounded surfaces adapted to present an optimal welding interface in combination with the casing exterior wall surface. The longitudinal edges 35 are preferably parallel to each other and to the central axis of the casing. They are spaced apart by a width dimension that is substantially greater than the width dimension of the aperture 24. The plate therefore substantially overlaps the aperture and the welds are located spaced from the aperture edges 25.

The periphery 32 is completed by transverse plate edges 34 situated at top and bottom sides of the plate. The transverse edges 34 are substantially perpendicular to the longitudinal edges 35, extending the width dimension of the plate. The transverse edges 34 are spaced apart to define the overall height dimension of the anvil device 10.

The edges 34, it is understood, could project substantially above and below the anvil shoulder 23 to present additional welding surfaces along the casing exterior wall 12. However, I have found that the additional strength imparted by such an arrangement is minimal and adds substantially to the overall cost of producing the device 10. Preferably, then, the height dimension between transverse edges 34 is equivalent to the overall height dimension for the entire anvil device.

Figure 1:
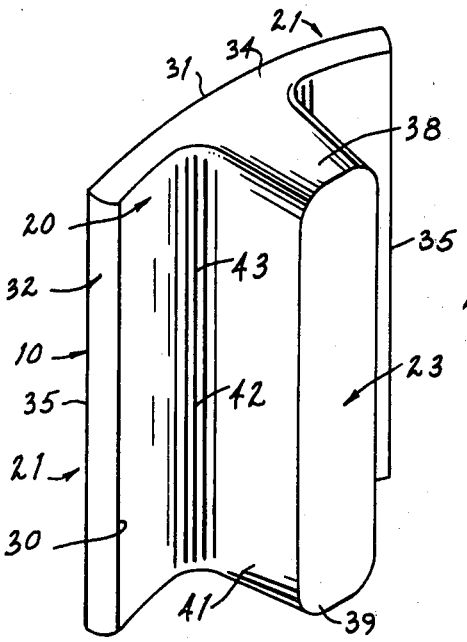
FIG. 1 is a pictorial view of the present anvil device.

The anvil shoulder 23 as shown in FIGS. 1 and 3, extends the full height of the mounting plate 21. It is preferably centered between the longitudinal edges 35 of the mounting plate 21 and projects inwardly from the surface 30 along a line passing through the casing axis. In other words, the shoulder projects radially toward the axis of a cylindrical casing when the plate surface 30 is mounted against the exterior wall 12 of the casing.

The anvil shoulder 23 is provided with a striking surface 38 at one end adapted to be forceably engaged by a complementary hammering surface on the impact tool 15. Opposite the striking surface 38 is a bottom end 39. Surface 38 and end 39 define opposed ends of the anvil shoulder spaced apart longitudinally by side surfaces 41. The side surfaces are substantially axial with the casing axis when the anvil device is mounted. They intersect with the inside surface 30 of the plate along longitudinal fillets 42. The fillets 42 join the side surfaces to the plate along smooth arcuate curves.

The fillets 42 are provided to avoid stress concentrations at the intersection of the anvil shoulder with mounting plate. Additionally, they serve to substantially center the anvil shoulder within the aperture 24 as shown in FIG. 2. The smooth fillet surfaces 42 cam against the edges 25 of the aperture and automatically center the anvil shoulder with the surfaces 41 thereof spaced inwardly by substantially equal distances from the aperture shoulders 24.

The anvil device 10 is mounted to the casing 11 simply by inserting the anvil shoulder 23 through the aperture until the surface 30 of plate 21 comes into flush engagement with the exterior wall 12 of the casing. The device 10 is allowed free access through the departure due to the overall larger dimension of the aperture 24 in relation to similar dimensions of the anvil shoulder.

The device 10 is mounted so that the bottom surface 39 of the anvil shoulder bears against the bottom wall 28 of the aperture. This creates an open space above the striking surface 38 and the aperture top end 27. Contact between the bottom anvil end 39 and the aperture provides a support surface for the anvil member during the welding operation and also a surface for transmission of impact energy during the case driving operation.

When the anvil device is in proper position in relation to the aperture and casing, welds 45 are made between the longitudinal side edges 35 of the mounting plate and the adjacent surfaces of the casing. The welds 45 are substantially axial and are spaced, as shown in FIG. 2, a substantial distance from the side edges 25 of the aperture. Impact forces are thus transmitted to the casing along the welds 45 and directly along the bottom aperture end 28. The forces transmitted to the casing are isolated substantially from the weakened area of the casing directly adjacent to the aperture. The forces thus transmitted are not concentrated along shear planes adjacent the aperture but are spread substantially about the adjacent areas of the casing.

During operation, the impact device 15 is operated directly against the striking surface 38 of the anvil shoulder 23. Impact forces thus imparted are transmitted through the anvil body and to the casing. In response, the casing 11 will move successively deeper into the drilled hole. The present anvil device 10 does not represent a substantial expense in relation to the casing. It can economically be left in position at the bottom of the hole when the drilling operation is complete.

The above description and attached drawings are given by way of example to set forth a preferred form of the present invention. Other forms or modifications thereof may be envisioned that fall within the scope of the invention as set forth in the following claims.

What is claimed is:

1. A well casing anvil device for attachment to a hollow well casing having cylindrical exterior and interior walls, mountable through a preformed aperture of a prescribed width through the walls for engagement by an axial impact device within the casing to drive the hollow well casing axially further into a well hole, said anvil device comprising:

a rigid anvil body;

said body having a mounting plate having a width greater than the width of the preformed aperture with a convex surface formed thereon to fit flush against the cylindrical exterior wall of the casing on opposite sides of the preformed aperture, covering the aperture;

said body having an anvil shoulder projecting outwardly from the mounting plate surface and adapted to extend through the casing aperture from the exterior wall and into the casing interior;

said anvil shoulder having an axially facing striking surface to be engaged within the casing by the impact device.

2. The well casing anvil device as claimed by claim 1 wherein the mounting plate includes a peripheral edge bounding the plate surface, adapted to be welded to the casing along the exterior wall thereof at locations thereon spaced from the aperture.

3. A casing anvil device as claimed by claim 1 for attachment to a hollow casing having an axially elongated aperture formed through the walls thereof with axially spaced top and bottom ends and laterally spaced side edges of prescribed width and height dimensions wherein said anvil shoulder further includes:

a bottom surface opposite the striking surface and spaced from a striking surface to adapt the anvil shoulder to be inserted through the aperture with the bottom surface resting against the bottom end of the aperture and with the striking surface clear of the top aperture end.

4. The casing anvil device as claimed by claim 3 wherein the anvil shoulder further includes:

side surfaces joining the bottom surface and the striking surface, adapting the anvil shoulder to be inserted through the aperture with spaces between the side surfaces and the side edges of the aperture.

5. The casing anvil device as claimed by claim 1 wherein the anvil shoulder and mounting plate are integral and further includes an integral arcuate fillet at the area of intersection between the shoulder and plate.

6. The casing anvil device as claimed by claim 1 wherein the striking surface is convex and protrudes perpendicularly from the plate.

7. The casing anvil device as claimed by claim 1 wherein the plate is elongated and includes a longitudinal rounded peripheral edge adapted to fit axially along the casing and to be welded securely to the casing at locations thereon spaced from the aperture.

8. A casing anvil device as claimed by claim 7 for attachment to a hollow casing having an axially elongated aperture formed through the walls thereof with axially spaced top and bottom ends and laterally spaced side edges of prescribed width and height dimensions wherein said anvil shoulder further includes:

a bottom surface opposite the striking surface and spaced from a striking surface to adapt the anvil shoulder to be inserted through the aperture with the bottom surface resting against the bottom end of the aperture and with the striking surface clear of the top aperture end.

9. The casing anvil device as claimed by claim 8 wherein the plate is rectangular, with said longitudinal rounded peripheral edge forming elongated side edges thereof, joined by transverse end edges; and wherein the striking surface and bottom surface of the anvil shoulder are aligned respectively with the transverse end edges of the plate.

10. The casing anvil device as claimed by claim 1 wherein the plate is rectangular, having elongated side edges joined by opposed transverse end edges;

wherein the anvil shoulder includes a bottom surface spaced opposite the striking surface by elongated shoulder sides;

wherein the bottom shoulder surface and the striking surface are aligned respectively with the transverse end edges of the plate.

11. The casing anvil device as claimed by claim 1 wherein the plate is elongated and includes parallel longitudinal side edges; and wherein the anvil shoulder is elongated, and includes longitudinal side edges joined together by the striking surface and spaced inward from and parallel to the plate side edges.

12. The casing anvil as claimed by claim 11 wherein the plate includes transverse end edges joining the longitudinal side edges and wherein the striking surface is aligned with one of the plate transverse end edges.

* * * * *